US007231156B2

(12) United States Patent
Fujita et al.

(10) Patent No.: US 7,231,156 B2
(45) Date of Patent: Jun. 12, 2007

(54) IMAGE FORMING APPARATUS

(75) Inventors: Shigeo Fujita, Nagano-ken (JP); Tatsuro Osawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 94 days.

(21) Appl. No.: 11/088,674

(22) Filed: Mar. 23, 2005

(65) Prior Publication Data

US 2005/0220469 A1 Oct. 6, 2005

(30) Foreign Application Priority Data

Mar. 25, 2004 (JP) ..... P2004-089841

(51) Int. Cl.
*G03G 15/00* (2006.01)

(52) U.S. Cl. ..... 399/49

(58) Field of Classification Search ..... 399/9, 399/15, 49, 60, 98, 99, 107, 301; 347/116
See application file for complete search history.

(56) References Cited

U.S. PATENT DOCUMENTS

2002/0098004 A1* 7/2002 Hama et al. ..... 399/49
2002/0186980 A1* 12/2002 Tsuruya et al. ..... 399/49

FOREIGN PATENT DOCUMENTS

| | | | |
|---|---|---|---|
| JP | 11-237773 | | 8/1999 |
| JP | 2000-241242 | | 9/2000 |
| JP | 2001-175039 | * | 6/2001 |
| JP | 2002-214854 | | 7/2002 |

* cited by examiner

*Primary Examiner*—Sandra L. Brase
(74) *Attorney, Agent, or Firm*—Hogan & Hartson LLP

(57) ABSTRACT

In an image forming apparatus, a patch image is formed on the surface of a belt-like image support for supporting a toner image on the surface and is detected with a patch sensor placed facing a placing part on a roller for stretching the belt-like image support. An angle adjustment mechanism for adjusting the attachment angle of the patch sensor rotates the patch sensor with an intersection point of an optical axis of the patch sensor and a sensing face as the center for adjusting the attachment angle of the patch sensor. The patch sensor is attached to one member forming a part of a support frame of the image support and the attachment angle of the member is adjusted, whereby the attachment angle of the patch sensor is adjusted.

7 Claims, 14 Drawing Sheets

IMAGE FORMING APPARATUS

BACKGROUND OF THE INVENTION

1. Field of the Invention

This invention relates to an image forming apparatus such as a printer, a facsimile, or a copier using electrophotography for forming a toner image on a record material of paper, etc., and more particularly to an art of forming a toner image (patch image) of a predetermined pattern on the surface of a toner image support to adjust the density (and gradation) of a toner image and measuring the density with a density sensor (patch sensor).

2. Description of the Related Art

In an image forming apparatus in a related art, a patch image is formed on the surface of a belt-like image support for supporting a toner image on the surface and is detected with a patch sensor placed facing a placing part on a roller for stretching the belt-like image support. (Refer to Japanese Patent Publication JP-A-2002-214854.)

According to the configuration, it can be expected that it will be made possible to detect the patch image on the surface of the belt-like image support with good accuracy in the placing part on the roller where a flutter does not occur on the belt.

On the function of the patch sensor, the distance and the angle relative to a measured object largely affect the sensing performance of the patch sensor. Particularly, if the measured object is a curved surface, the angle accuracy needs to be managed strictly.

The image forming apparatus in the related art described above is not provided with an adjustment mechanism of the angle which the patch sensor forms with the measured object (patch image on the image support), and the position of the patch sensor is guaranteed by the parts accuracy.

Thus, in the image forming apparatus in the related art, variations in patch sensor attachment angle easily occur, resulting in large density variations after sensing; this is a problem.

SUMMARY OF THE INVENTION

It is an object of the invention to provide an image forming apparatus capable of detecting the density of a patch image on the surface of an image support with good accuracy.

According to the invention, there is provided an image forming apparatus where in a patch image is formed on the surface of a belt-like image support for supporting a toner image on the surface and is detected with a patch sensor placed facing a placing part on a roller for stretching the belt-like image support, characterized by an angle adjustment mechanism for adjusting the attachment angle of the patch sensor.

According to the configuration, the patch image on the surface of the belt-like image support can be detected in the placing part on the roller where a flutter does not occur on the belt and it is made possible to adjust the angle of the patch sensor relative to the patch image on the image support, so that it is made possible to detect the density of the patch image on the surface of the image support with good accuracy.

Preferably, the angle adjustment mechanism is an angle adjustment mechanism for rotating the patch sensor with the intersection point of the optical axis of the patch sensor and a sensing face as the center for adjusting the attachment angle of the patch sensor.

According to the configuration, it is made possible to adjust the angle without changing the distance between the patch sensor and the sensing face (patch image on the surface of the image support), so that it is made possible to detect the density of the patch image on the surface of the image support with better accuracy.

To the end, according to the invention, there is provided an image forming apparatus wherein a patch image is formed on the surface of an image support for supporting a toner image on the surface and is detected with a patch sensor, characterized by an angle adjustment mechanism for rotating the patch sensor with the intersection point of the optical axis of the patch sensor and a sensing face as the center for adjusting the attachment angle of the patch sensor.

According to the configuration, it is made possible to adjust the angle of the patch sensor relative to the patch image on the image support, so that it is made possible to detect the density of the patch image on the surface of the image support with good accuracy.

Moreover, it is made possible to adjust the angle without changing the distance between the patch sensor and the sensing face (patch image on the surface of the image support), so that it is made possible to detect the density of the patch image on the surface of the image support with better accuracy.

Preferably, the patch sensor is attached to one member for forming a part of a support frame of the image support and the attachment angle of the one member is adjusted, whereby the attachment angle of the patch sensor is adjusted.

In doing so, the angle adjustment mechanism can be formed without increasing the number of parts. Moreover, assuming that the patch sensor is placed on a different member from the member forming a part of the support frame of the image support, it becomes difficult to make high-accuracy angle adjustment of the patch sensor relative to the surface of the image support. However, the patch sensor is attached to the one member forming a part of the support frame of the image support, whereby it becomes easy to make high-accuracy angle adjustment of the patch sensor relative to the surface of the image support. Further, the image support, the support frame thereof, and the patch sensor can be put into a unit, so that angle adjustment of the patch sensor in the single unit is made possible. Therefore, the need for adjusting the angle of the patch sensor after the image support and the patch sensor are separately built in the image forming apparatus is eliminated.

Preferably, a cleaning mechanism for cleaning the sensor face of the patch sensor is attached to the one member.

In doing so, it is made possible to clean the sensor face of the patch sensor by the cleaning mechanism. At the same time, when the angle of the patch sensor is adjusted, the cleaning mechanism also rotates in a similar manner, so that the relative position between the patch sensor and its cleaning mechanism can also be prevented from getting dislocated as the angle of the patch sensor is adjusted.

According to another aspect of the invention, there is provided an adjusting method of a patch sensor in an image forming apparatus, wherein the patch sensor is opposed to a roller for stretching an image support on which a toner image is supported, the method comprising the steps of:

placing the patch sensor in a rotatable state with respect to a frame to which the patch sensor is attached;

providing an angle adjustment jig including a pair of arms provided at opposite ends thereof, a reference terminal provided between the arms, and a pair of reference holes formed in the pair of arms, and a gage attached to the angle adjustment jig; and attaching the angle adjustment jig to the frame by inserting a pair of bosses of the roller into reference holes of the angle adjustment jig so as to be rotatable around an axis of roller, such that a tip of the reference terminal and a tip of the gage abut with an attachment face of the patch sensor;

wherein if a measurement value of the gage is not a set value, the patch sensor is rotated so that the measurement value becomes the set value, and when the measurement value of the gage becomes the set value, the patch sensor is fixed to the frame, in a state in which an attachment angle of the patch sensor is properly adjusted.

Preferably, the patch sensor maybe adjusted by the angle adjustment jig so that the optical axis of the patch sensor passes through the center of the roller.

Further, according to the invention, a reference base for resetting the gage attached to the angle adjustment jig is provided with a pair of reference bosses provided at opposite ends thereof corresponding to the bosses of the roller and a reference face provided between the reference bosses corresponding to the attachment face; and the angle adjustment jig is attached to the reference base by fitting the reference holes of the angle adjustment jig into the reference bosses of the reference base such that the angle adjustment jig is rotated around the reference bosses to abut a tip of the reference terminal of the angle attachment jig with the reference face of the reference base, and the gage is reset in a state that the tip of the gage abuts with the reference face.

DETAILED DESCRIPTION OF THE PREFERRED EMBODIMENTS

Referring now to the accompanying drawings, there are shown preferred embodiments of the invention.

Figure 1:
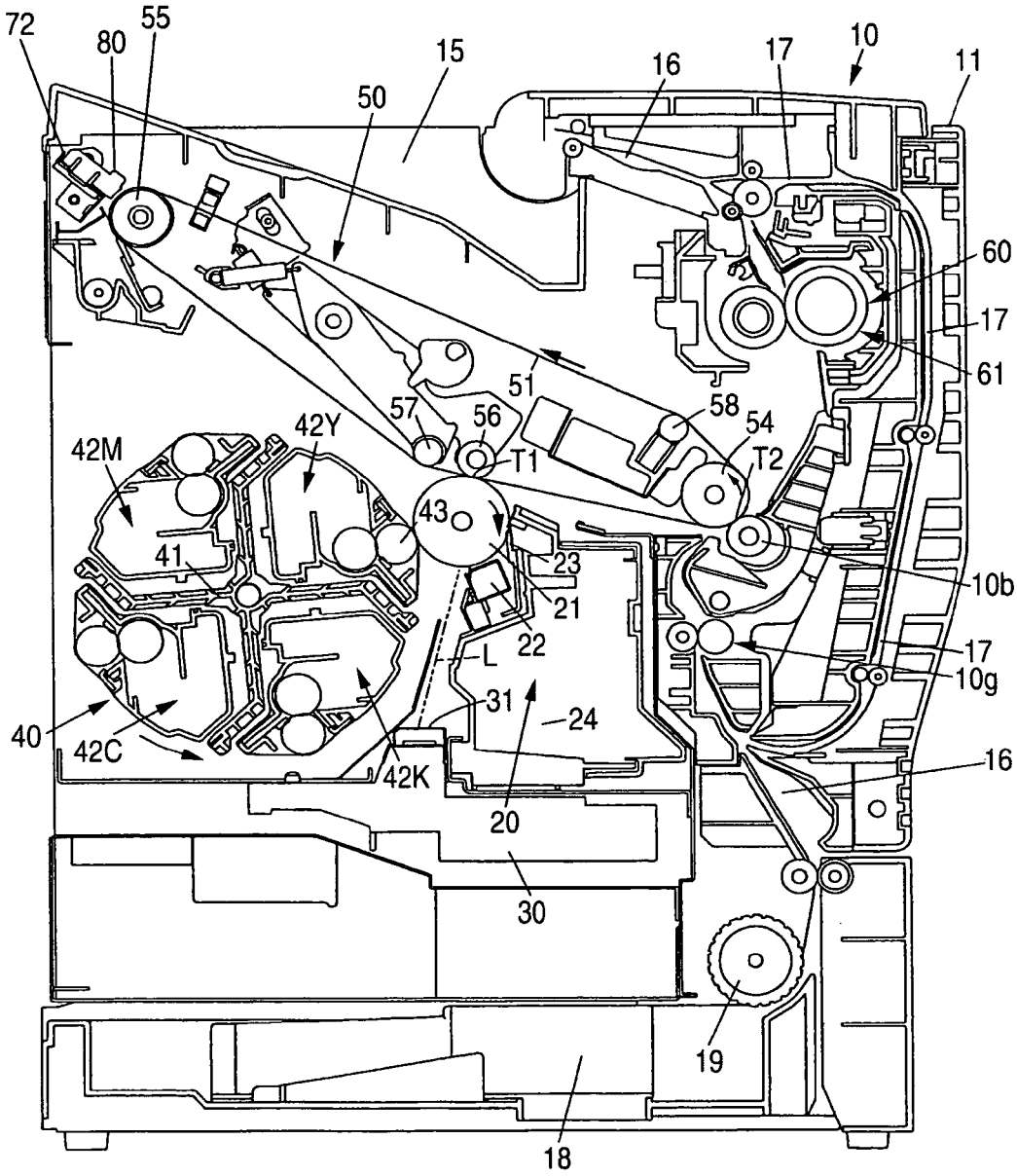
FIG. 1 is a schematic side view showing the internal structure of one embodiment of an image forming apparatus according to the invention.

FIG. 1 is a schematic side view showing the internal structure of one embodiment of an image forming apparatus according to the invention.

The image forming apparatus is a color image forming apparatus capable of transporting A3-size or smaller-size paper (record material) in a portrait feed state and A4-size or smaller-size paper in a landscape feed state and forming a full-color image on both sides of the paper.

The image forming apparatus includes a case 10 and an image support unit 20, an exposure unit 30 as exposure device, a developing machine 40 as developing device, an intermediate transfer body unit 50, and a fixing unit (fixer) 60 as fixing device, which are housed in the case 10.

The case 10 is provided with a main unit frame 11 of an apparatus main unit (see FIG. 10) to which the units, etc., are attached.

The image support unit 20 has a photosensitive body 21 having a photosensitive layer on the outer peripheral surface and a corona charger (scorotron charger) 22 as charging device for uniformly charging the outer peripheral surface of the photosensitive body 21. The outer peripheral surface of the photosensitive body 21 uniformly charged by the corona charger 22 is selectively exposed to laser light L from the exposure unit 30 to form an electrostatic latent image, toner of a developer is given to the electrostatic latent image in the developing machine 40 to form a visible image (toner image), and the toner image is primarily transferred to an intermediate transfer belt 51 of an intermediate transfer body (image support) of the intermediate transfer body unit 50 in a primary transfer part T1 and further is secondarily transferred to paper in a secondary transfer part T2.

The image support unit 20 is provided with a cleaning device (cleaning blade) 23 for removing the toner remaining on the surface of the photosensitive body 21 after the primary transfer and a waste toner storage section 24 as a waste toner reservoir section for storing the waste toner removed by the cleaning device 23.

The case 10 contains a transport passage 16 for transporting the paper having the toner image formed on one side by the secondary transfer part T2 described above to a paper discharge section (paper discharge tray section) 15 on the top of the case 10 and a return passage 17 for switching back the paper transported to the secondary transfer part T2 on the transport passage 16 and returning the paper to the secondary transfer part T2 to also form an image on an opposite side.

A paper feed tray 18 for stacking and holding a plurality of sheets of paper and a paper feed roller 19 for feeding the paper one sheet at a time to the secondary transfer part T2 are provided in the lower part of the case 10.

The developing machine 40 is a rotary developing machine and has a plurality of developing machine cartridges each storing toner detachably attached to a rotation body main unit 41. In the embodiment, a yellow developing machine cartridge 42Y, a magenta developing machine cartridge 42M, a cyan developing machine cartridge 42C, and a black developing machine cartridge 42K are provided and the rotation body main unit 41 rotates at 90-degree pitches in the arrow direction in FIG. 1, whereby a developing roller 43 can be selectively abutted against the photosensitive body 21 for selectively developing the surface of the photosensitive body 21.

The exposure unit 30 applies the laser light L through an exposure window 31 to the photosensitive body 21.

The intermediate transfer body unit 50 includes a unit frame 70 (see FIG. 8), a drive roller 54, a driven roller 55, a primary transfer roller 56, a guide roller 57 for stabilizing the state of the belt 51 in the primary transfer part T1, and a tension roller 58 supports on the unit frame 70 for rotation, and the intermediate transfer belt 51 placed on the rollers and stretched, wherein the belt 51 is circulated in the arrow direction in the figure. The primary transfer part T1 is formed between the photosensitive body 21 and the primary transfer roller 56, and the secondary transfer part T2 is formed in the press contact part of the drive roller 54 and a secondary transfer roller 10*b* provided in the main unit.

The secondary transfer roller 10*b* can be brought into and out of contact with the drive roller 54 (therefore the intermediate transfer belt 51). When the secondary transfer roller 10*b* comes in contact with the drive roller 54, the secondary transfer part T2 is formed.

Therefore, to form a color image, toner images of a plurality of colors are superposed on each other with the secondary transfer roller 10*b* out of contact with the intermediate transfer belt 51 to form a color image and then the secondary transfer roller 10*b* comes in contact with the intermediate transfer belt 51 and paper is supplied to the contact part (secondary transfer part T2) at the timing controlled in a gate roller pair 10*g*, whereby the color image (toner image) is transferred to the paper.

The paper to which the toner image has been transferred passes through a heating roller pair 61 of the fixing unit 60, whereby the toner image is fused and fixed and the paper is ejected to the paper discharge section 15.

Figure 2:
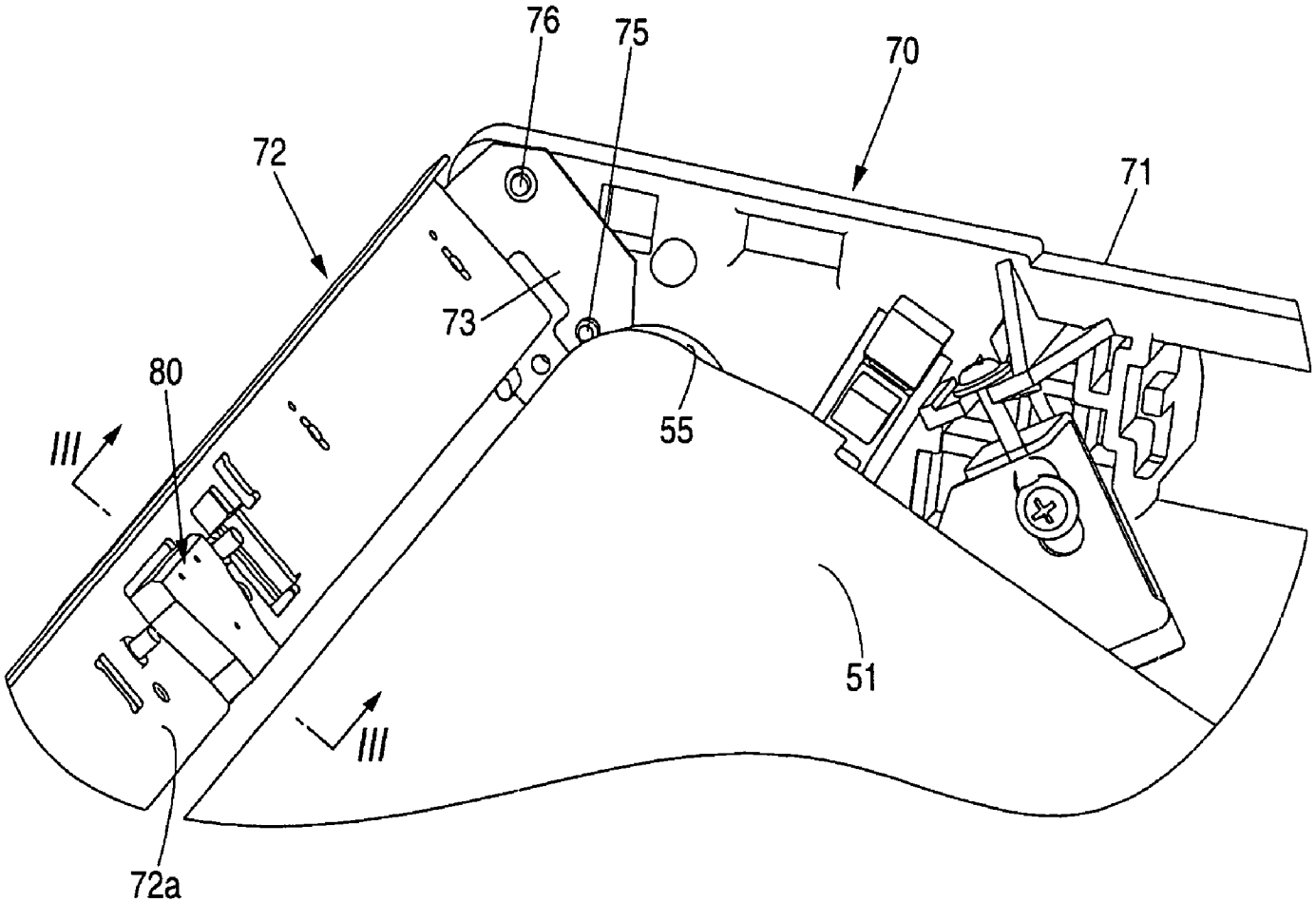
FIG. 2 is a perspective view showing the main part.
Figure 3:
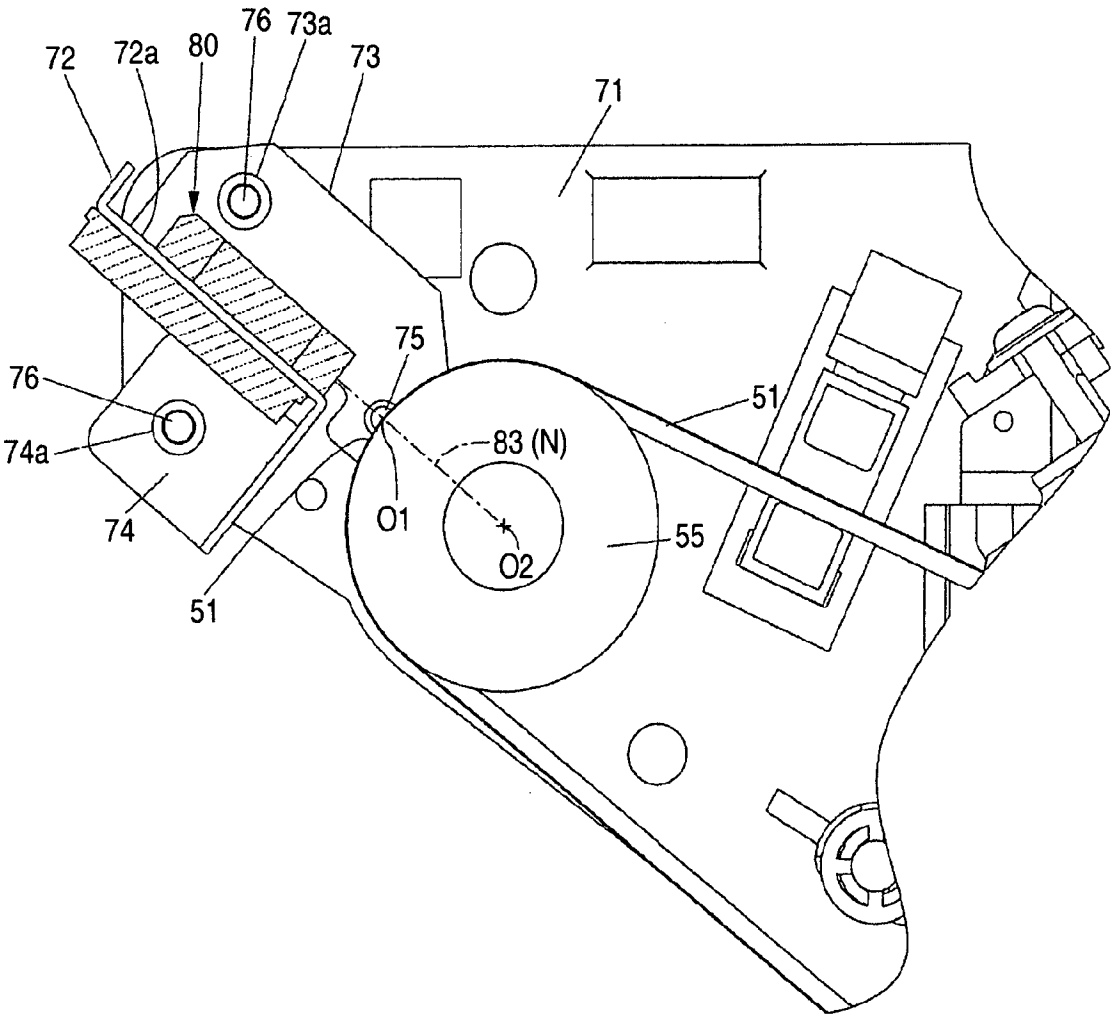
FIG. 3 is a sectional view taken on line III—III in FIG. 2.

FIG. 2 is a perspective view showing the main part and FIG. 3 is a sectional view taken on line III—III in FIG. 2.

In the image forming apparatus, a patch image of a predetermined pattern (not shown) is formed on the surface of the intermediate transfer belt 51 to adjust the density (and gradation) of an image formed on the intermediate transfer belt 51 of an image support as described above and the density is measured with a patch sensor 80 placed facing a placing part on the roller 55 for stretching the intermediate transfer belt 51.

Figure 8:
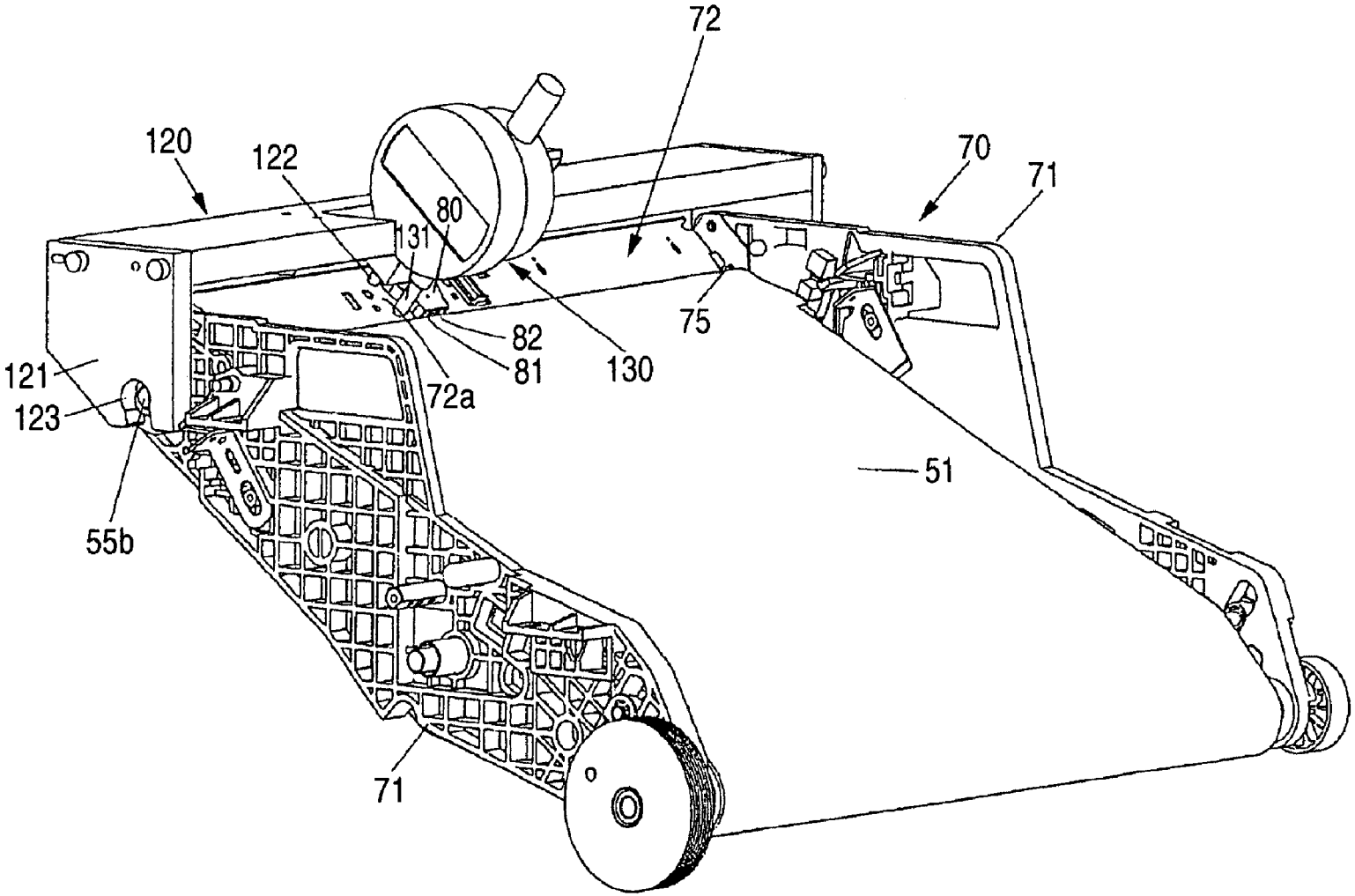
FIG. 8 is a perspective view showing an intermediate transfer unit at the angle adjustment time.

The patch sensor 80 contains a light projection element and a light reception element (not shown) and is a reflection optical sensor for projecting light onto the patch image (surface of the intermediate transfer belt 51) through a light projection window 81 (see FIG. 8) from the light projection element and receiving the reflected light on the light reception element through a light reception window 82 (see FIG. 8).

In FIG. 3, numeral 83 denotes the optical axis of the projected light and the reflected light.

As shown in FIGS. 2, 3, and 8, the unit frame 70 of the intermediate transfer body unit 50 has a pair of side frames 71 and 71 for supporting the drive roller 54, the driven roller 55, etc., for rotation and a horizontal frame 72 for joining the side frames 71 and 71, and the patch sensor 80 is attached to the horizontal frame 72.

As shown in FIGS. 2 and 3, the horizontal frame 72 has a pair of arm parts 73 bent at right angles at both ends and a pair of tongue pieces 74 bent at right angles at both ends (see FIG. 3), and the arm part 73 is supported on the side frame 71 by a shaft 75. Therefore, the horizontal frame 72 can rotate on the shaft 75, but after the attachment angle of the horizontal frame 72 is adjusted as described later, the arm parts 73 and the tongue pieces 74 are fixed to the side frames 71 by fixing screws 76, whereby the horizontal frame 72 is fixed to the side frames 71 so as to strongly join the side frames 71 and 71.

As seen from the description made above, in the image forming apparatus, the patch sensor 80 is attached to the horizontal frame 72 of one member forming a part of the unit frame 70 of the intermediate transfer belt 51 of the image support and the attachment angle of the horizontal frame 72 of the one member is adjusted, whereby the attachment angle of the patch sensor 80 can be adjusted.

That is, in the embodiment, the side frames 71 and the horizontal frame 72 supported on the side frames 71 for rotation to which the patch sensor 80 is attached make up an angle adjustment mechanism for adjusting the attachment angle of the patch sensor 80.

In FIGS. 2 and 3, etc., only one arm part 73, etc., is shown, but the arm part 73, etc., is provided at both ends of the horizontal frame 72.

As shown in FIG. 3, a center O1 of the shaft 75 is matched with intersection point O1 of the optical axis 83 of the patch sensor 80 and the surface of the intermediate transfer belt 51 of the sensing face when viewed from the axial direction of the roller 55 (therefore, rotation axial direction of the image support).

Therefore, the patch sensor 80 can rotate on the intersection point O1.

The arm part 73 and the tongue piece 74 are formed with a hole 73*a* and a hole 74*a* for allowing the fixing screws 76 to pass through and the inner diameter of each hole is larger than the outer diameter of the fixing screw 76, so that the horizontal frame 72 (therefore, the patch sensor 80) can be rotated in the range in which the hole 73*a*, 74*a* can move relatively to the fixing screw 76.

When the angle of the patch sensor 80 is adjusted to a proper angle as described below, the optical axis 83 of the patch sensor 80 passes through a center O2 of the roller 55 on which the intermediate transfer belt 51 is placed, as shown in FIG. 3. In other words, the attachment angle of the patch sensor 80 is adjusted so that the optical axis 83 passes through the center O2 of the roller 55. That is, the attachment angle of the patch sensor 80 is adjusted so that a normal N at a measurement position on the surface of the intermediate transfer belt 51 (see O1) and the optical axis 83 match.

The attachment angle of the patch sensor 80 is adjusted as follows:

(i) The fixing screws 76 are loosened so as to place the horizontal frame 72 (therefore, the patch sensor 80) in a rotatable state.

Figure 4:
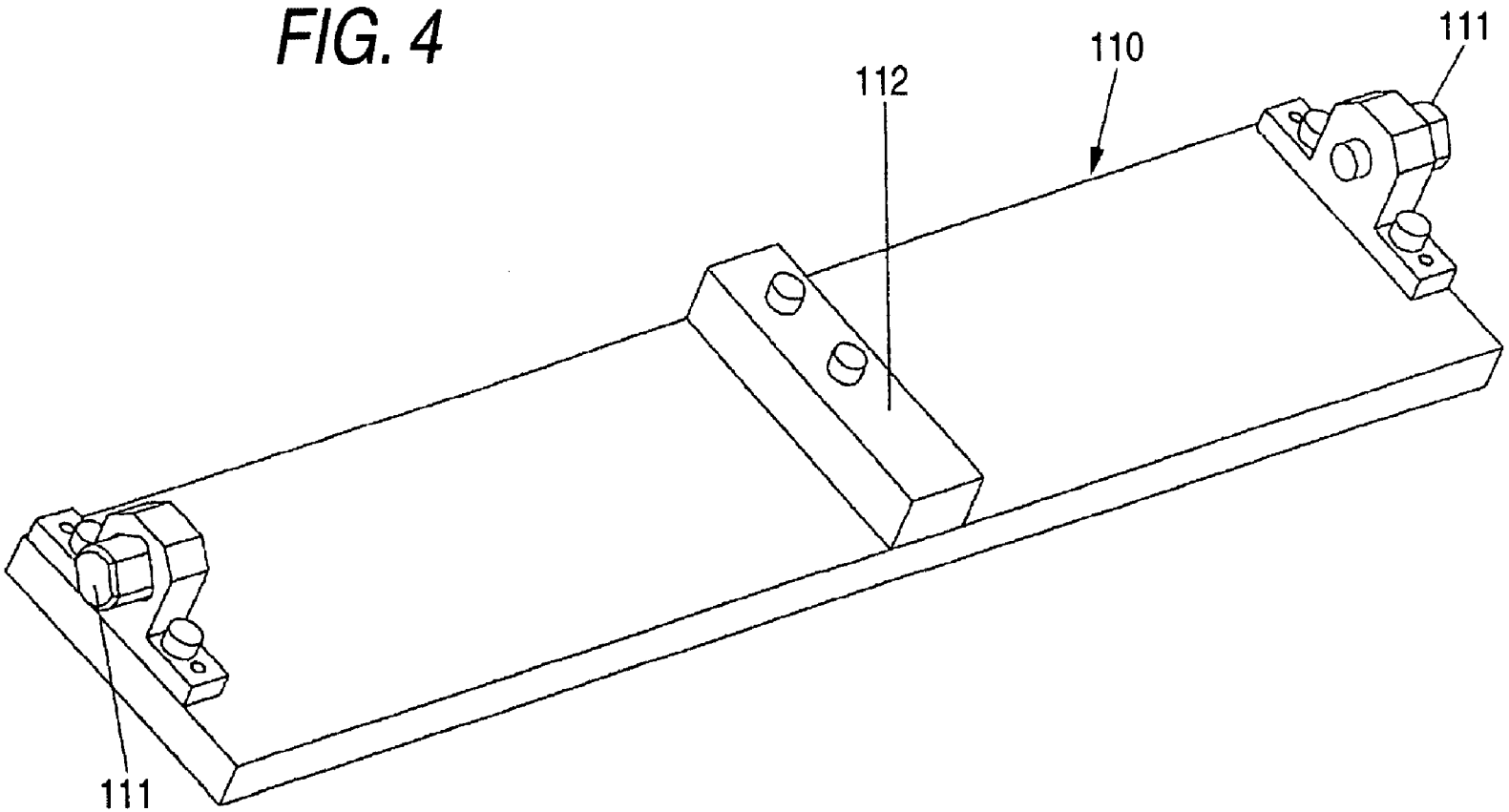
FIG. 4 is a perspective view showing a reference base.
Figure 5:
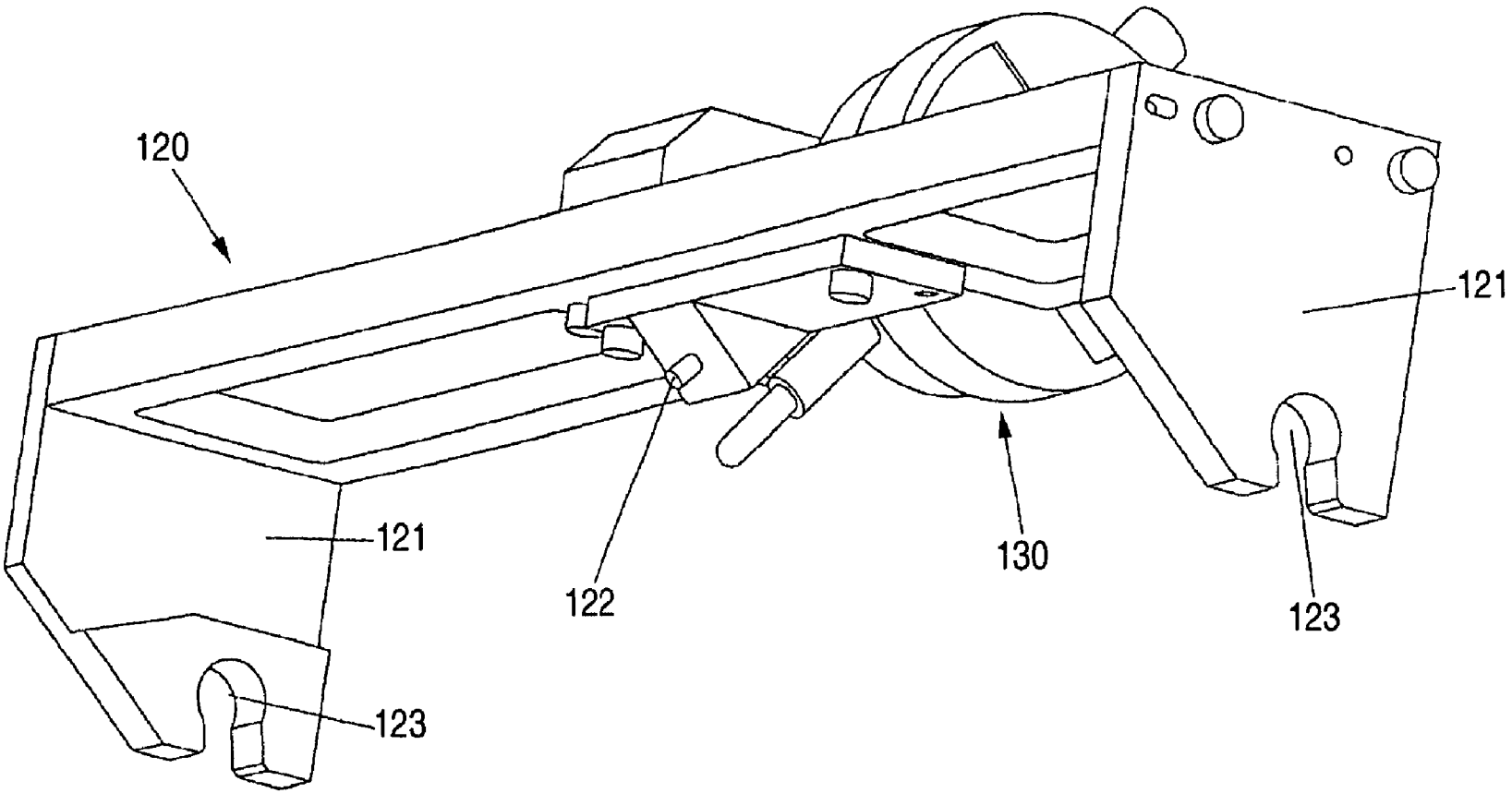
FIG. 5 is a perspective view showing an angle adjustment jig.

(ii) On the other hand, a reference base 110 as shown in FIG. 4 and an angle adjustment jig 120 (see FIG. 5) that can be set on the reference base 110 are provided.

The reference base 110 has a pair of reference bosses 111 provided at both ends and a reference face 112 provided between the reference bosses 111. The pair of reference bosses 111 corresponds to a pair of bosses 55*b* (only one is shown in FIG. 8) on the same axis as the roller 50 to which the patch sensor 80 is opposed, and the reference face 112 corresponds to an attachment face 72*a* of the patch sensor 80 on the horizontal frame 72 (see FIGS. 2 and 3). Assuming that the patch sensor 80 is attached to the reference face 112, the reference face 112 is formed so that the optical axis 83 of the patch sensor 80 passes through the center O2 of the roller 55 (center of the reference boss 111) when viewed from the axial direction of the roller 55.

The jig 120 has a pair of arms 121 provided at both ends and a reference terminal 122 provided between the arms 121. The pair of arms 121 is formed at the tip with reference holes 123 fitted into the reference bosses 111 of the reference base 110 and the pair of bosses 55*b* on the same axis as the roller 55.

A dial gage 130 is attached to the jig 120.

Figure 6:
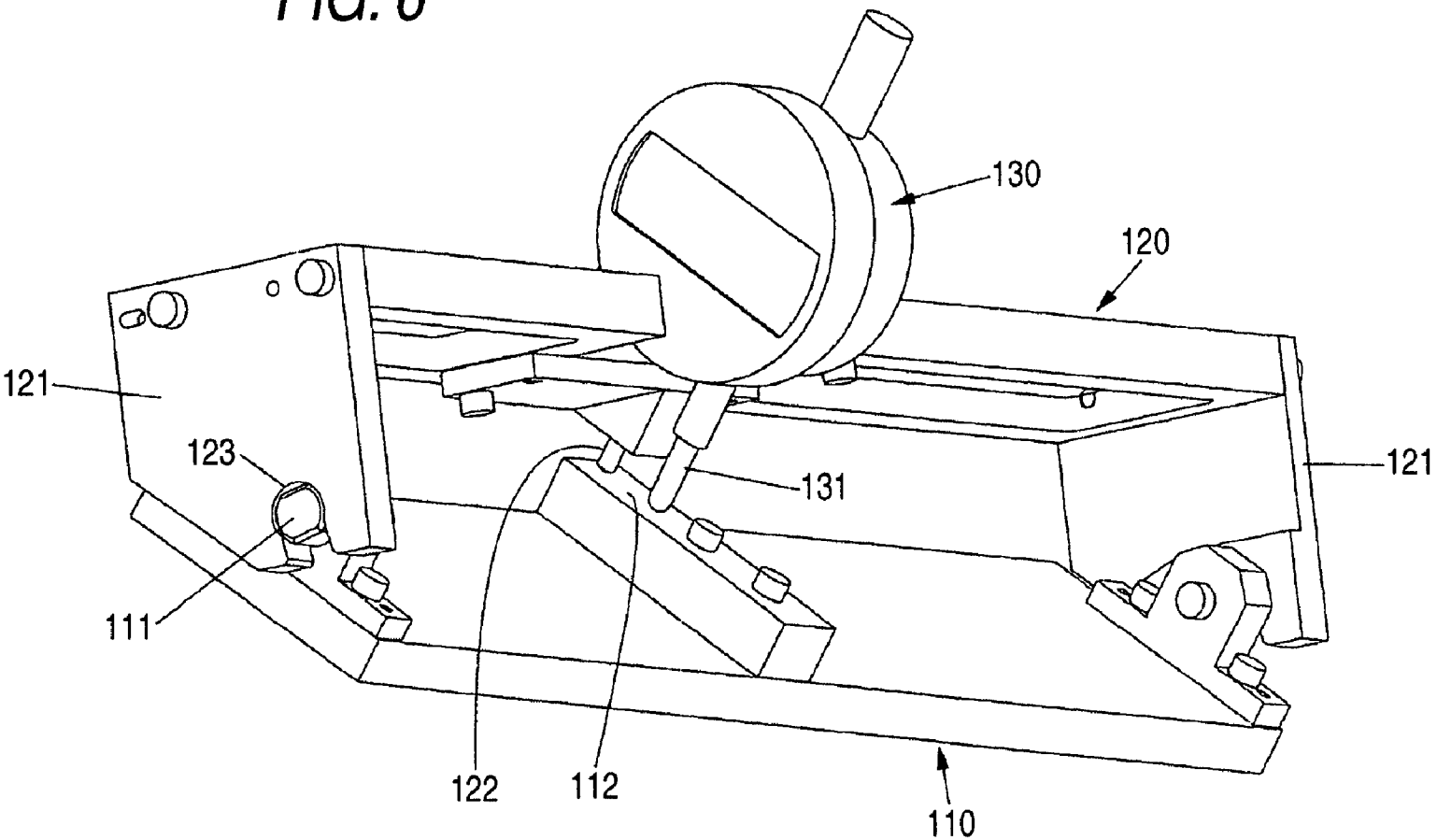
FIG. 6 is a perspective view showing a state in which the angle adjustment jig is set on the reference base.
Figure 7:
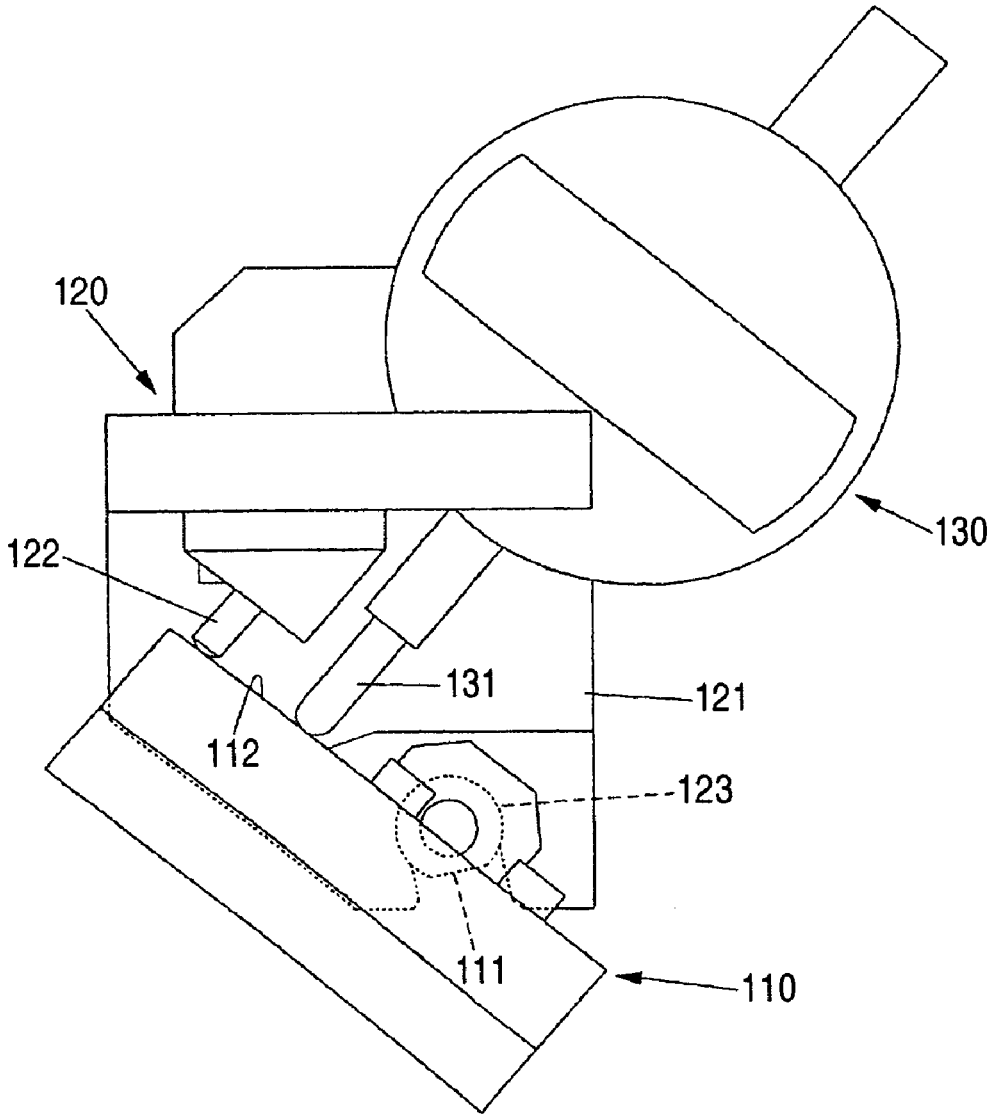
FIG. 7 is a side view showing the state in which the angle adjustment jig is set on the reference base.

(iii) As shown in FIGS. 6 and 7, the reference holes 123 of the jig 120 are fitted into the reference bosses 111 of the reference base 110 and the jig 120 is rotated around the reference bosses 111 for abutting the tip of the reference terminal 122 against the reference face 112 of the reference base 110 and then the dial gage 130 is reset to 0. Since a gage head 131 of the dial gage 130 is urged in a projection direction at all times, when the jig 120 is rotated for abutting the tip of the reference terminal 122 against the reference face 112 of the reference base 110, the tip of the gage head 131 of the dial gage 130 also abuts the reference face 112. In FIGS. 6 and 7, the reference base 110 is drawn in a state in which the state shown in FIG. 4 is rotated 180 degrees.

Figure 9:
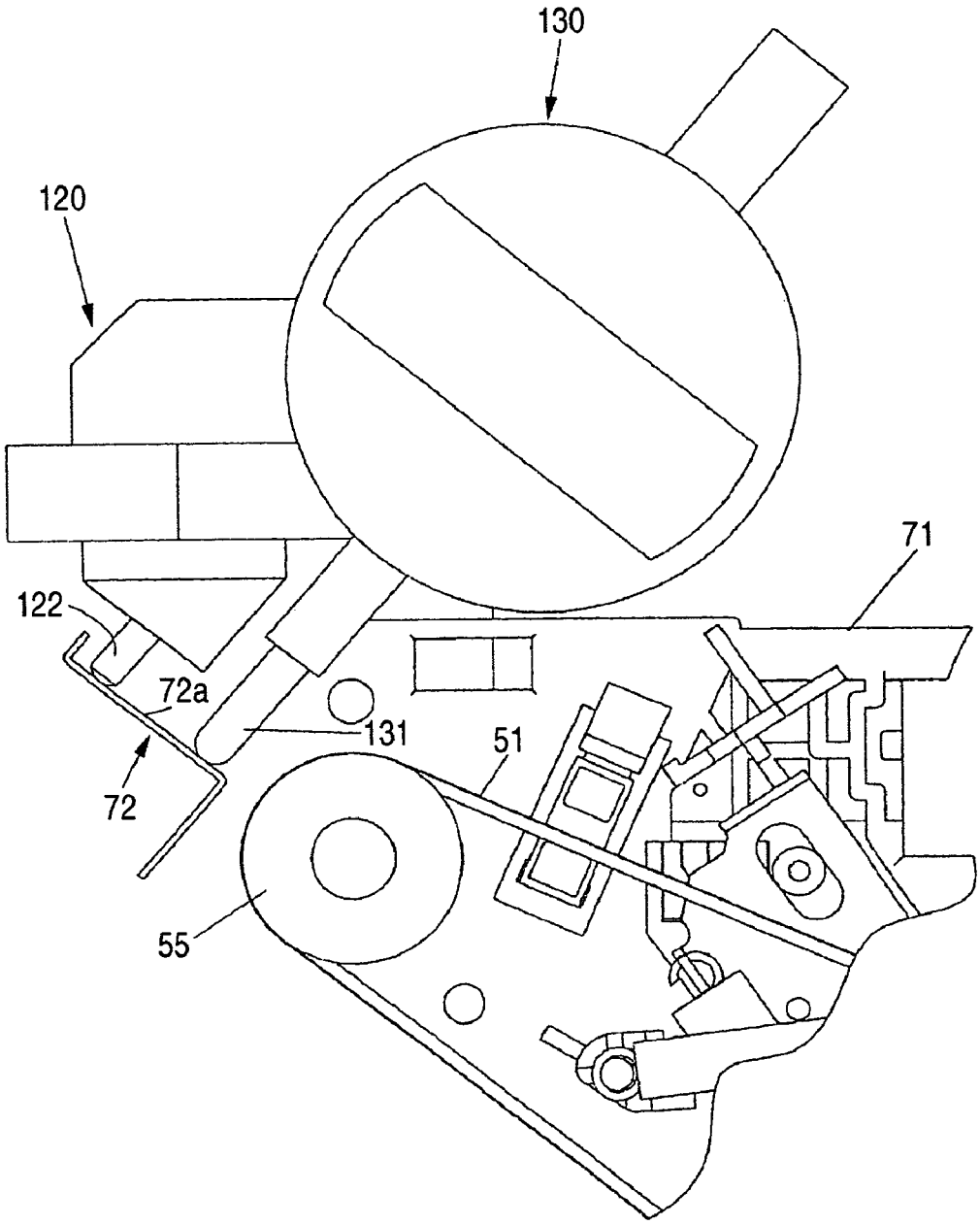
FIG. 9 is an enlarged side view with the intermediate transfer unit in FIG. 8 partially omitted.

(iv) The jig 120 is detached from the reference base 110 and as shown in FIGS. 8 and 9, the reference holes 123 are fitted into the pair of bosses 55*b* on the same axis as the roller 55 and the jig 120 is rotated around the bosses 55*b* for abutting the tip of the reference terminal 122 and the tip of the gage head 131 of the dial gage 130 against the attachment face 72*a* of the patch sensor 80 on the horizontal frame 72.

Here, if the measurement value of the dial gage 130 is not 0, the horizontal frame 72 (therefore, the patch sensor 80) is rotated around the axis 75 so that the measurement value becomes 0. At the position where the measurement value of the dial gage 130 becomes 0, the fixing screws 76 are fastened for fixing the horizontal frame 72 to the side frames 71.

Accordingly, the patch sensor 80 is attached in a state in which the attachment angle of the patch sensor 80 is adjusted to the proper angle previously described with reference to FIG. 3. As described above, the reference bosses 111 of the reference base 110 correspond to the bosses 55*b* and the reference face 112 corresponds to the attachment face 72*a* of the patch sensor 80 on the horizontal frame 72 and assuming that the patch sensor 80 is attached to the reference face 112, the reference face 112 is formed so that the optical axis 83 of the patch sensor 80 passes through the center O2 of the roller 55 (center of the reference boss 111).

When the horizontal frame 72 is rotated around the axis 75, the jig 120 is rotated around the bosses 55*b* following rotation of the horizontal frame 72.

According to the image forming apparatus as described above, the following advantages can be provided:

(a) The image forming apparatus is an image forming apparatus wherein a patch image is formed on the surface of the belt-like image support 51 for supporting a toner image on the surface and is detected with the patch sensor 80 placed facing the placing part on the roller 55 for stretching the belt-like image support 51, and includes the angle adjustment mechanism for adjusting the attachment angle of the patch sensor 80. Thus, according to the image forming apparatus, the following advantage can be provided:

The patch image on the surface of the belt-like image support 51 can be detected with the patch sensor 80 in the placing part on the roller 55 where a flutter does not occur on the belt-like image support 51 and it is made possible to adjust the angle of the patch sensor 80 relative to the patch image on the image support 51, so that it is made possible to detect the density of the patch image on the surface of the image support with good accuracy.

(b) The angle adjustment mechanism is designed for rotating the patch sensor 80 with the intersection point O1 of the optical axis 83 of the patch sensor 80 and the sensing face (the surface of the intermediate transfer belt 51 and the patch image formed on the surface) as the center for adjusting the attachment angle of the patch sensor, so that it is made possible to adjust the angle without changing the distance between the patch sensor 80 and the sensing face. Therefore, it is made possible to detect the density of the patch image on the surface of the image support with better accuracy at the proper distance and at the proper angle.

That is, the image forming apparatus is an image forming apparatus wherein a patch image is formed on the surface of the image support 51 for supporting a toner image on the surface and is detected with the patch sensor, and wherein the patch sensor 80 is rotated with the intersection point O1 of the optical axis 83 of the patch sensor 80 and the sensing face as the center for adjusting the attachment angle of the patch sensor 80. Thus, it is made possible to adjust the angle without changing the distance between the patch sensor 80 and the sensing face and it is made possible to detect the density of the patch image on the surface of the image support with very good accuracy.

(c) The patch sensor 80 is attached to the horizontal frame 72 of one member forming a part of the support frame 70 of the image support 51 and the attachment angle of the one member 72 is adjusted, whereby the attachment angle of the patch sensor 80 is adjusted. Thus, the angle adjustment mechanism can be formed without increasing the number of parts. Moreover, assuming that the patch sensor 80 is placed on a different member from the member 72 forming a part of the support frame 70 of the image support 51, it becomes difficult to make high-accuracy angle adjustment of the patch sensor relative to the surface of the image support. However, the patch sensor 80 is attached to the one member 72 forming a part of the support frame 70 of the image support 51, whereby it becomes easy to make high-accuracy angle adjustment of the patch sensor relative to the surface of the image support. Further, the image support 51, the support frame 70 thereof, and the patch sensor 80 can be put into a unit (see FIG. 8), so that angle adjustment of the patch sensor 80 in the single unit is made possible. Therefore, the need for adjusting the angle of the patch sensor after the image support and the patch sensor are separately built in the image forming apparatus is eliminated.

ANOTHER EMBODIMENT

Figure 10:
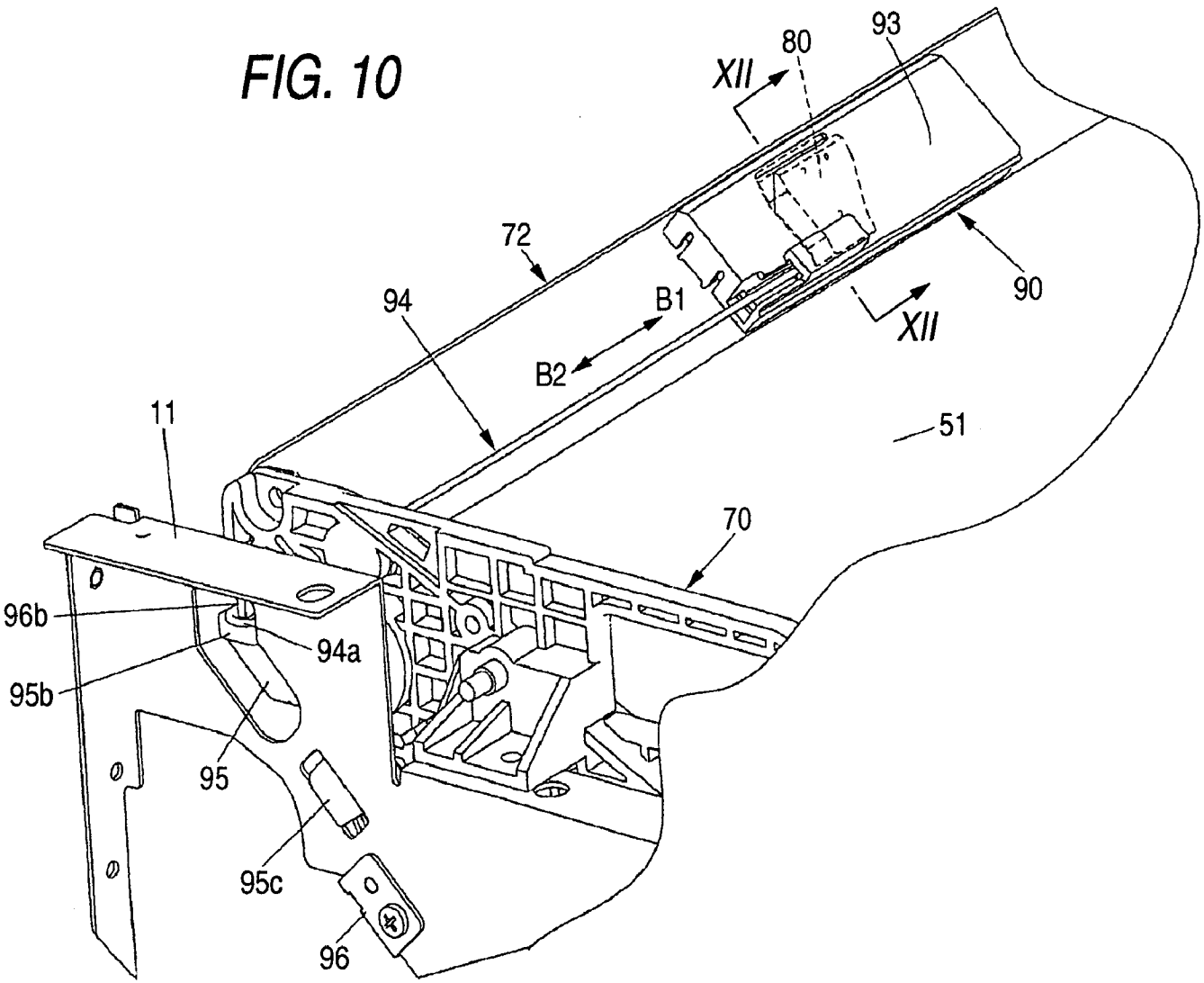
FIG. 10 is a perspective view showing another embodiment of the invention.
Figure 11:
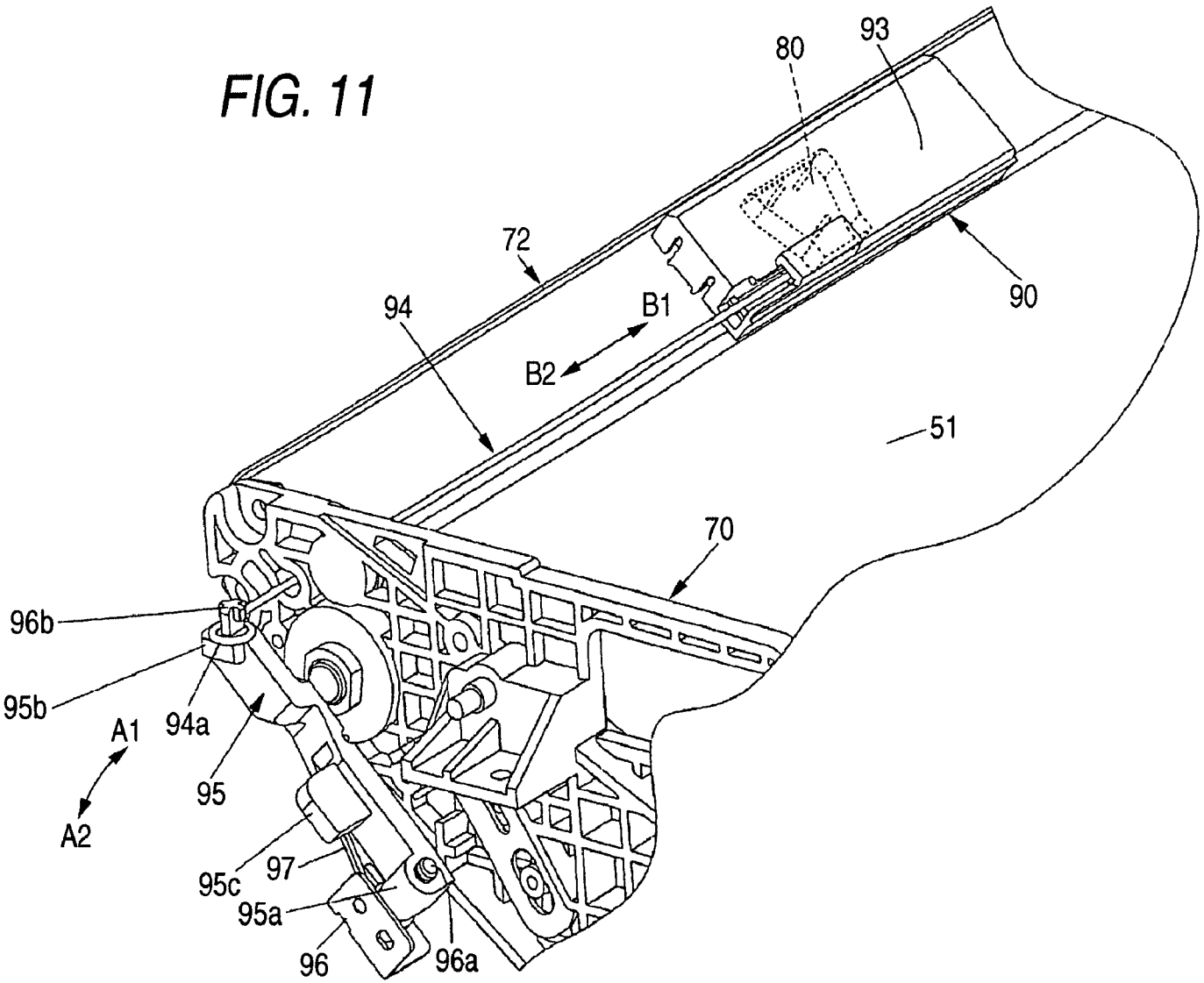
FIG. 11 is a perspective view with main unit frame 11 in FIG. 10 omitted
Figure 12:
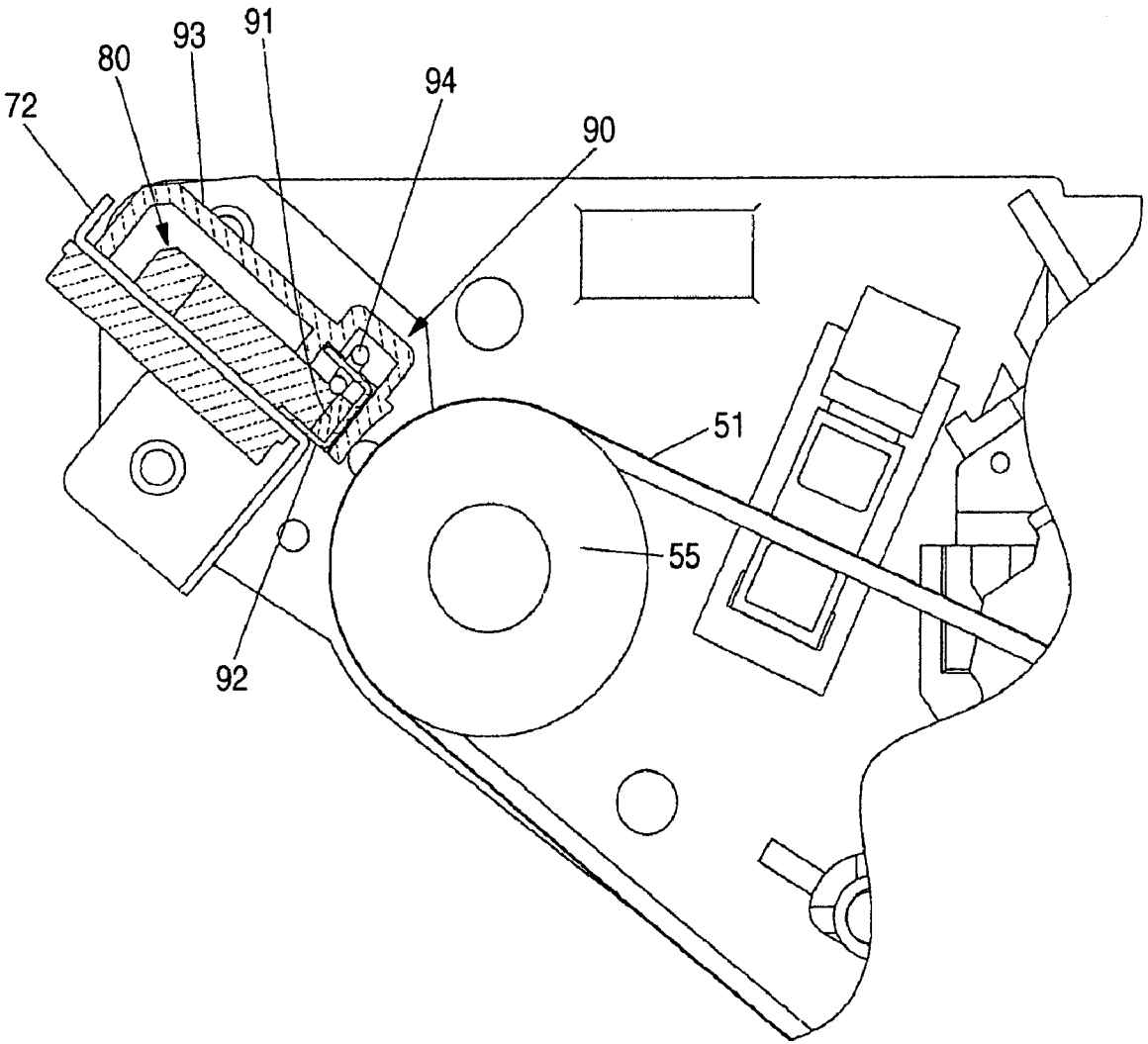
FIG. 12 is a sectional view taken on line XII—XII in FIG. 10.
Figure 13:
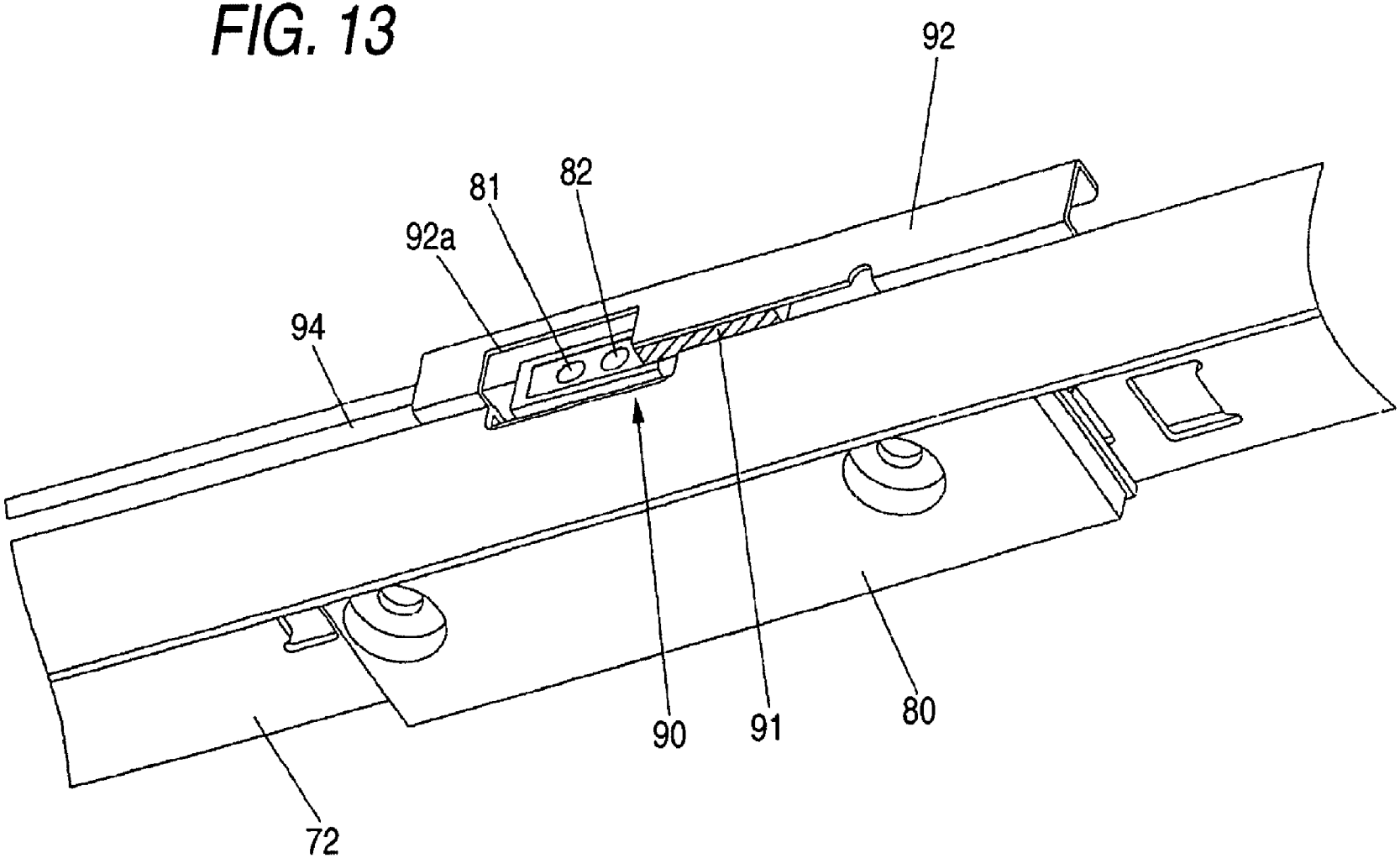
FIG. 13 is a perspective view of a cleaning mechanism.
Figure 14:
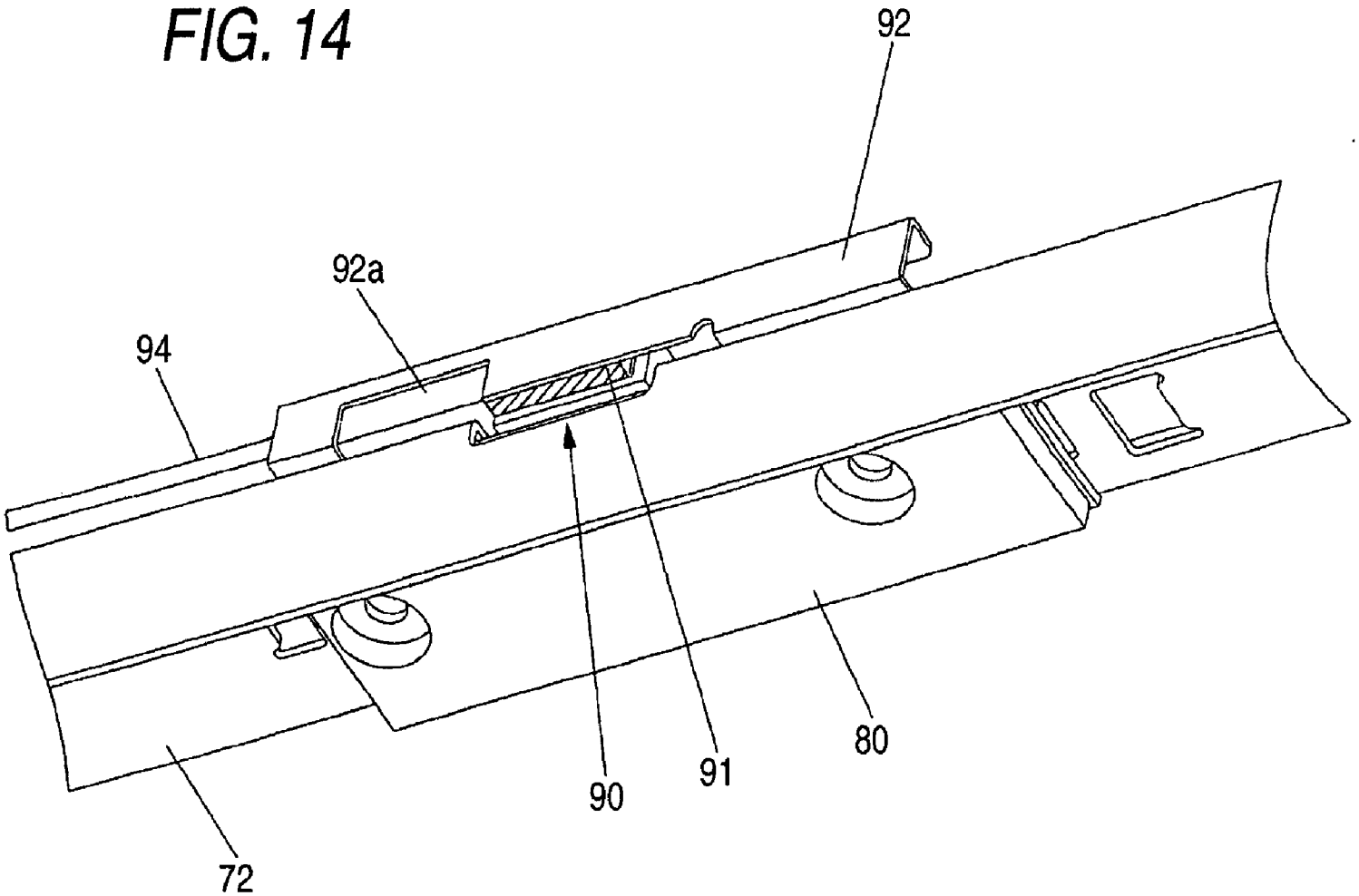
FIG. 14 is a perspective view of the cleaning mechanism.

FIG. 10 is a perspective view showing the main part of another embodiment of the invention, FIG. 11 is a perspective view with main unit frame 11 in FIG. 10 omitted, and FIG. 12 is a sectional view taken on line XII—XII in FIG. 10. FIGS. 13 and 14 are drawings each to view cleaning mechanism 90 from below in a slanting direction with guide-cum-cover member 93 omitted.

The embodiment differs from the above-described embodiment in that the cleaning mechanism 90 for cleaning the sensor face (light projection window 81 and light reception window 82) of the patch sensor 80 is provided on the horizontal frame 72 of the attachment member of the patch sensor 80.

The cleaning mechanism 90 is made up of a cleaning member (for example, sponge, felt, raised material, etc.,) 91 for scrubbing the sensor face of the patch sensor 80, a retention member 92 for retaining the cleaning member 91, and a guide member 93 for guiding slide of the retention member 92 (see FIGS. 10 and 12), as shown in FIGS. 10 to 14. The guide member 93 also serves as a cover of the patch sensor 80, the cleaning member 91, and the retention member 92, and is fixed to the horizontal frame 72.

The retention member 92 is joined to an operation lever 95 by a rod 94, as shown in FIG. 11.

The operation lever 95 has one end 95*a* supported by a shaft 96*a* of a support plate 96 attached to a main unit frame 11 (see FIG. 10) for rotation and an opposite end 95*b* to which one end 94*a* of the rod 94 is joined.

Therefore, when the operation lever 95 rotates in the arrow A1, A2 direction, the rod 94 and the retention member 92 (therefore, the cleaning member 91) slide in the arrow B1, B2 direction (as shown in FIGS. 13 and 14), and the sensor face of the patch sensor 80 is scrubbed and cleaned by the cleaning member 91.

As shown in FIG. 11, the one end 94*a* of the rod 94 is formed like a ring and this ring-like part 94*a* is loosely fitted into a projection 96*b* formed integrally with the operation lever 95.

Therefore, if the horizontal frame 72 and the cleaning mechanism 90 rotate as the attachment angle of the patch sensor 80 is adjusted, a torsional force does not occur on the rod 94 and thus the positional relationship between the cleaning mechanism 91 and the retention member 92 and the sensor face of the patch sensor 80 does not get dislocated.

A torsion spring 97 is provided around the shaft 96*a* for urging the operation lever 95 at all times in the arrow A2 direction, but the user can rotate the operation lever 95 in the arrow A1 direction by pressing an operation part 95*c* of the operation lever 95 with a finger.

In the embodiment, an open-close cover (side cover) (not shown) is provided on a side of the image forming apparatus (front face in FIG. 1). When the side cover is closed, the operation part 95*c* is pressed against the inside of the cover, rotating the operation lever 95 in the arrow A1 direction. When the side cover is opened, the operation lever 95 is rotated in the arrow A2 direction by the urging force of the torsion spring 97.

The side cover is opened and closed when a developing machine cartridge 42 (Y, K, C, M) or an image support unit 20 is replaced (detached and attached).

Therefore, in the embodiment, whenever the side cover is opened and closed (on a regular basis to some extent) to replace the cartridge or the unit, the cleaning member 91 slides as shown in FIGS. 12 and 13 for automatically cleaning the sensor face of the patch sensor 80. The user can also manually clean the sensor face of the patch sensor 80 by opening the side cover and pressing the operation part 95*c* for rotating the operation lever 95.

The retention member 92 is provided with an opening (window) 92*a* as shown in FIG. 13

When the operation lever 95 is rotated in the arrow A1 direction in FIG. 11, the rod 94 and the retention member 92 (therefore, the cleaning member 91) slide in the arrow B1 direction.

In this state, the opening 92*a* of the retention member 92 opens the sensor face of the patch sensor 80 as shown in FIG. 13 and thus a patch image can be detected and an image can be formed.

According to the embodiment, the cleaning mechanism 90 for cleaning the sensor face of the patch sensor 80 is attached to the horizontal frame 72, so that it is made possible to clean the sensor face of the patch sensor 80 by the cleaning mechanism 90. At the same time, when the angle of the patch sensor 80 is adjusted, the cleaning mechanism 90 also rotates in a similar manner, so that the relative position between the patch sensor 80 and its cleaning mechanism 90 can also be prevented from getting dislocated as the angle of the patch sensor 80 is adjusted.

Although the embodiments of the invention have been described, it is to be understood that the invention is not limited to the specific embodiments thereof and various modifications and changes may be made without departing from the spirit and the scope of the invention.

For example, in the description of the embodiments, the image support is an intermediate transfer body, but the invention can also be applied to the case where the image support is a photosensitive body.

What is claimed is:

1. An image forming apparatus comprising:

a belt-like image support for supporting a toner image on a surface thereof; and a patch sensor placed facing a placing part on a roller for stretching the belt-like image support, wherein a patch image is formed on a surface of the belt-like image support and is detected with the patch sensor, wherein an angle adjustment mechanism for adjusting an attachment angle of the patch sensor is provided in the image forming apparatus, and wherein the patch sensor is attached to one member for forming a part of a support frame of the image support and an attachment angle of the one member is adjusted, whereby the attachment angle of the patch sensor is adjusted.

2. The image forming apparatus according to claim 1 wherein a cleaning mechanism for cleaning a sensor face of the patch sensor is attached to the one member.

3. An image forming apparatus comprising:

an image support for supporting a toner image on a surface thereof; and a patch sensor, wherein a patch image is formed on the surface of the image support and is detected with the patch sensor, wherein an angle adjustment mechanism for adjusting an attachment angle of the patch sensor is provided so as to rotate the patch sensor around an intersection point of an optical axis of the patch sensor and a sensing face of the image support, and wherein the patch sensor is attached to one member for forming a part of a support frame of the image support and an attachment angle of the one member is adjusted, whereby the attachment angle of the patch sensor is adjusted.

4. The image forming apparatus according to claim 3 wherein a cleaning mechanism for cleaning a sensor face of the patch sensor is attached to the one member.

5. An adjusting method of a patch sensor in an image forming apparatus, wherein the patch sensor is opposed to a roller for stretching an image support on which a toner image is supported, the method comprising the steps of:

placing the patch sensor in a rotatable state with respect to a frame to which the patch sensor is attached;

providing an angle adjustment jig including a pair of arms provided at opposite ends thereof, a reference terminal provided between the arms, and a pair of reference holes formed in the pair of arms, and a gage attached to the angle adjustment jig; and attaching the angle adjustment jig to the frame by inserting a pair of bosses of the roller into reference holes of the angle adjustment jig so as to be rotatable around an axis of roller, such that a tip of the reference terminal and a tip of the gage abut with an attachment face of the patch sensor;

wherein if a measurement value of the gage is not a set value, the patch sensor is rotated so that the measurement value becomes the set value, and when the measurement value of the gage becomes the set value, the patch sensor is fixed to the frame, in a state in which an attachment angle of the patch sensor is properly adjusted.

6. The adjusting method according to claim 5, wherein the patch sensor is adjusted by the angle adjustment jig so that the optical axis of the patch sensor passes through the center of the roller.

7. The adjusting method according to claim 5, wherein a reference base is provided with a pair of reference bosses provided at opposite ends thereof corresponding to the bosses of the roller and a reference face provided between the reference bosses corresponding to the attachment face; and the angle adjustment jig is attached to the reference base by fitting the reference holes of the angle adjustment jig into the reference bosses of the reference base such that the angle adjustment jig is rotated around the reference bosses to abut a tip of the reference terminal of the angle attachment jig with the reference face of the reference base, and the gage is reset in a state that the tip of the gage abuts with the reference face.

* * * * *